US011199073B2

(12) United States Patent
Stolboushkin et al.

(10) Patent No.: US 11,199,073 B2
(45) Date of Patent: Dec. 14, 2021

(54) PLUG WITH A RESETTABLE CLOSURE MEMBER

(71) Applicants: Eugene Stolboushkin, Houston, TX (US); Juan Carlos Flores Perez, The Woodlands, TX (US); Seth Burke, Spring, TX (US)

(72) Inventors: Eugene Stolboushkin, Houston, TX (US); Juan Carlos Flores Perez, The Woodlands, TX (US); Seth Burke, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/778,859

(22) Filed: Jan. 31, 2020

(65) Prior Publication Data

US 2021/0238957 A1 Aug. 5, 2021

(51) Int. Cl.

| | |
|---|---|
| ***E21B 34/10*** | (2006.01) |
| ***E21B 33/1295*** | (2006.01) |
| ***E21B 33/129*** | (2006.01) |
| *E21B 43/26* | (2006.01) |

(52) U.S. Cl.

CPC ..... *E21B 34/10* (2013.01); *E21B 33/1293* (2013.01); *E21B 43/26* (2013.01); *E21B 2200/05* (2020.05)

(58) Field of Classification Search

CPC .. E21B 34/102; E21B 33/129; E21B 33/1264; E21B 33/128; E21B 33/12; E21B 33/134; E21B 33/16; E21B 33/1265; E21B 2200/05; E21B 33/1295

See application file for complete search history.

(56) References Cited

U.S. PATENT DOCUMENTS

| | | | | |
|---|---|---|---|---|
| 3,298,385 | A * | 1/1967 | Jackson | F16L 37/113 137/112 |
| 4,694,903 | A * | 9/1987 | Ringgenberg | E21B 47/117 166/250.08 |
| 7,484,559 | B2 * | 2/2009 | Vert | E21B 7/20 166/155 |
| 7,703,532 | B2 * | 4/2010 | O'Malley | E21B 34/105 166/332.8 |
| 7,845,433 | B2 * | 12/2010 | Calderoni | E21B 21/106 175/317 |
| 8,191,634 | B2 * | 6/2012 | Xu | E21B 34/10 166/332.8 |

(Continued)

FOREIGN PATENT DOCUMENTS

| | | |
|---|---|---|
| EP | 1412612 B1 | 4/2004 |
| WO | 2014203155 A1 | 12/2014 |

OTHER PUBLICATIONS

International Search Report and Written Opinion for PCT Application No. PCT/US2021/015728; dated May 14, 2021; 10 pages.

*Primary Examiner* — Kenneth L Thompson

(74) *Attorney, Agent, or Firm* — Cantor Colburn LLP

(57) ABSTRACT

A plug with a resettable closure member including a body defining a flow bore and a closure member seat, a closure assembly connected to the body, the assembly includes a closure member and a magnetic catch disposed to hold the closure member in an open position, the magnetic catch being configured to release the closure member upon a selected hydrodynamic load upon the closure member.

10 Claims, 3 Drawing Sheets

(56) References Cited

U.S. PATENT DOCUMENTS

| | | | | |
|---|---|---|---|---|
| 9,163,479 | B2 * | 10/2015 | Rogers | E21B 34/066 |
| 9,309,744 | B2 * | 4/2016 | Frazier | E21B 33/1204 |
| 9,909,391 | B2 * | 3/2018 | Girola | E21B 23/02 |
| 10,113,379 | B2 * | 10/2018 | Calderoni | E21B 21/001 |
| 10,337,268 | B2 * | 7/2019 | Girola | E21B 19/16 |
| 10,352,124 | B2 | 7/2019 | Saraya | |
| 10,563,476 | B2 * | 2/2020 | Smith | E21B 33/1293 |
| 2009/0071654 | A1 | 3/2009 | O'Malley et al. | |
| 2011/0088908 | A1 * | 4/2011 | Xu | E21B 34/10 166/332.8 |
| 2013/0341034 | A1 * | 12/2013 | Biddick | F16K 1/2007 166/373 |
| 2016/0258259 | A1 * | 9/2016 | Walton | E21B 33/16 |
| 2016/0341002 | A1 * | 11/2016 | McKitrick, III | E21B 34/14 |
| 2017/0159406 | A1 * | 6/2017 | Flores Perez | E21B 34/066 |

* cited by examiner

PLUG WITH A RESETTABLE CLOSURE MEMBER

BACKGROUND

In the resource recovery industry, it is common to set plugs in a borehole environment to allow pressure based operations to be undertaken closer to a pressure source such as a surface location. Examples of such plugs include frac plugs (or packers, and the like) that are set in a borehole to facilitate fracturing a formation uphole of the frac plug. Frac plugs are commonly configured as conical seat structures receptive to a dropped ball for plugging. These work well but require large volumes of pumped fluid to convey balls to their seats and also require that the balls be recirculated back out of the well if a run such as a replacement perf gun is required. Flappers have been tried and successfully reduce pumped fluid requirements but suffer the same drawbacks vis-à-vis the pumping of any component after the flapper has been seated.

SUMMARY

Disclosed is an embodiment of a plug with a resettable closure member including a body defining a flow bore and a closure member seat, a closure assembly connected to the body, the assembly including a closure member; and a magnetic catch disposed to hold the closure member in an open position, the magnetic catch being configured to release the closure member upon a selected hydrodynamic load upon the closure member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
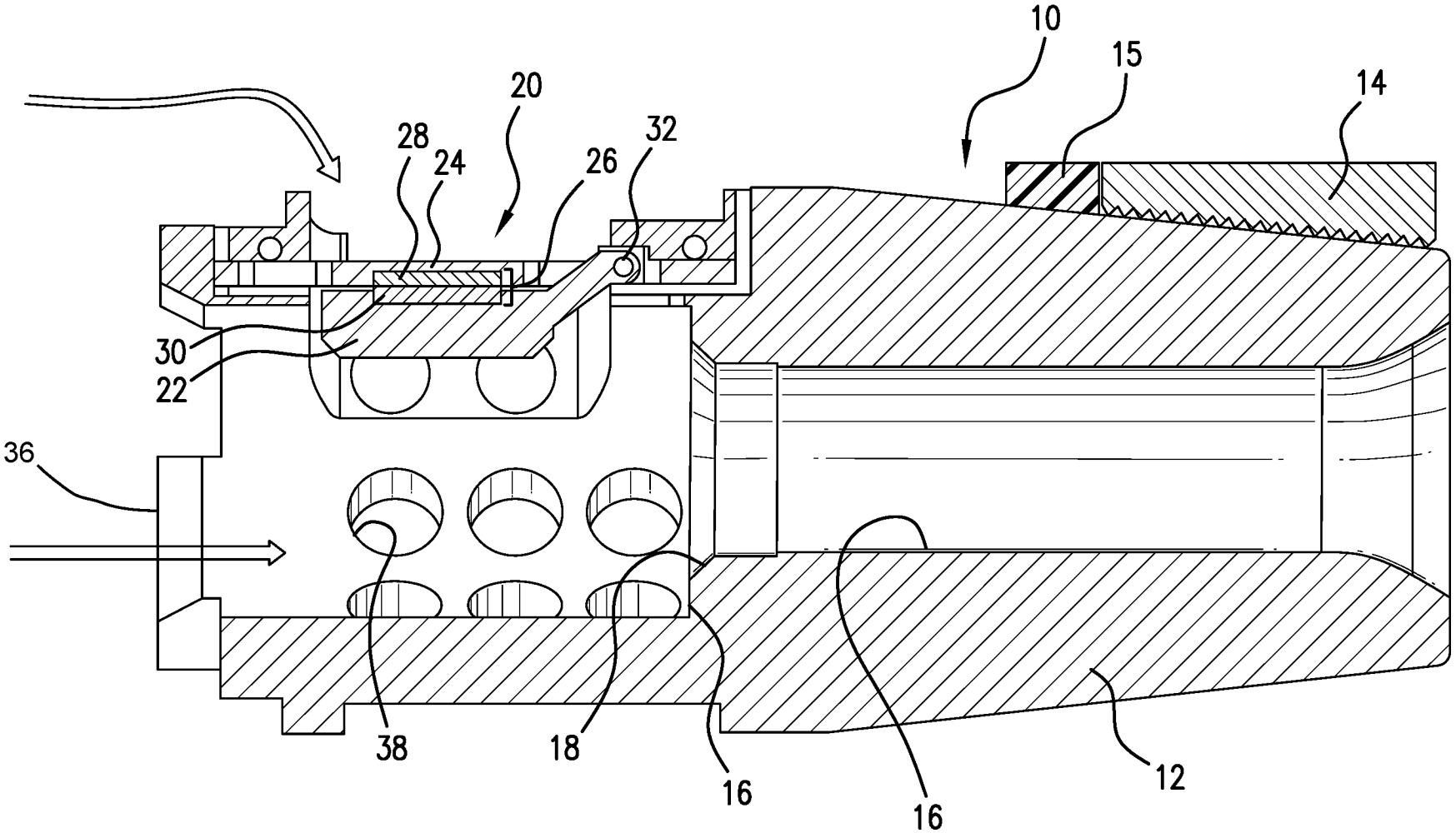
FIG. 1 is a schematic cross-sectional view of a plug with a resettable closure member as disclosed herein.

Referring to FIG. 1, a plug 10 is illustrated. The plug 10 comprises a cone body 12 (that can itself be one or more pieces), slip(s) 14, and seal 15. The plug 10 further comprises a flow bore 16, a closure member seat 18, and a closure member assembly 20.

Closure member assembly 20 is a resettable assembly. In other words, the closure member assembly will hold a closure member 22 in an open position and then allow that member 22 to close responsive to a selected hydrodynamic force. Once the assembly releases the member 22 in response to the selected threshold hydrodynamic force being experienced by the assembly 20, the closure member 22 (illustrated as a flapper) will close against the seat 18. The hydrodynamic force is created by a flow rate (but not below that rate) of a fluid flowing through the flow bore 16 and resetting upon flowback of fluid through the flow bore 16 in the opposite direction (reverse circulation). Hereby, the plug

10 may remain open to flow indefinitely while being closable simply by increasing the flow rate to above the selected threshold flow rate whereat the closure member 22 will close against seat 18. Importantly, the plug 10 may also be reopened by the reversed flow and will automatically reset the closure member 22 to its open position prior to having been subjected to the selected threshold flow rate. The closure member 22 will stay that way indefinitely until the flow rate is again raised to beyond the selected rate. The plug is hence resettable any number of times at the whim of the operator without need for pulling the plug from the borehole. This functionality is particularly useful in the case of a fracturing operation. It will be appreciated that occasionally during a frac operation, the perf guns (not shown) fail to discharge. In such condition the guns must be withdrawn from the borehole and new guns pumped in. In prior art systems, the pumping back in is not possible if the frac plug is closed. Without fluid flow through the frac plug, the guns may not be pumped to position. Accordingly, plugs of the prior art must be removed altogether or at least the ball on seat would need to be circulated out of the well before new guns could be pumped into place. The plug 10 allows replacement of guns without need for ancillary activities. The plug 10 will automatically reset itself upon pulling of the guns since the attendant flowback of fluid through the plug 10 will push the closure member 22 off seat 18 and float it back toward its fully open position whereat it will be automatically secured.

Figure 2:
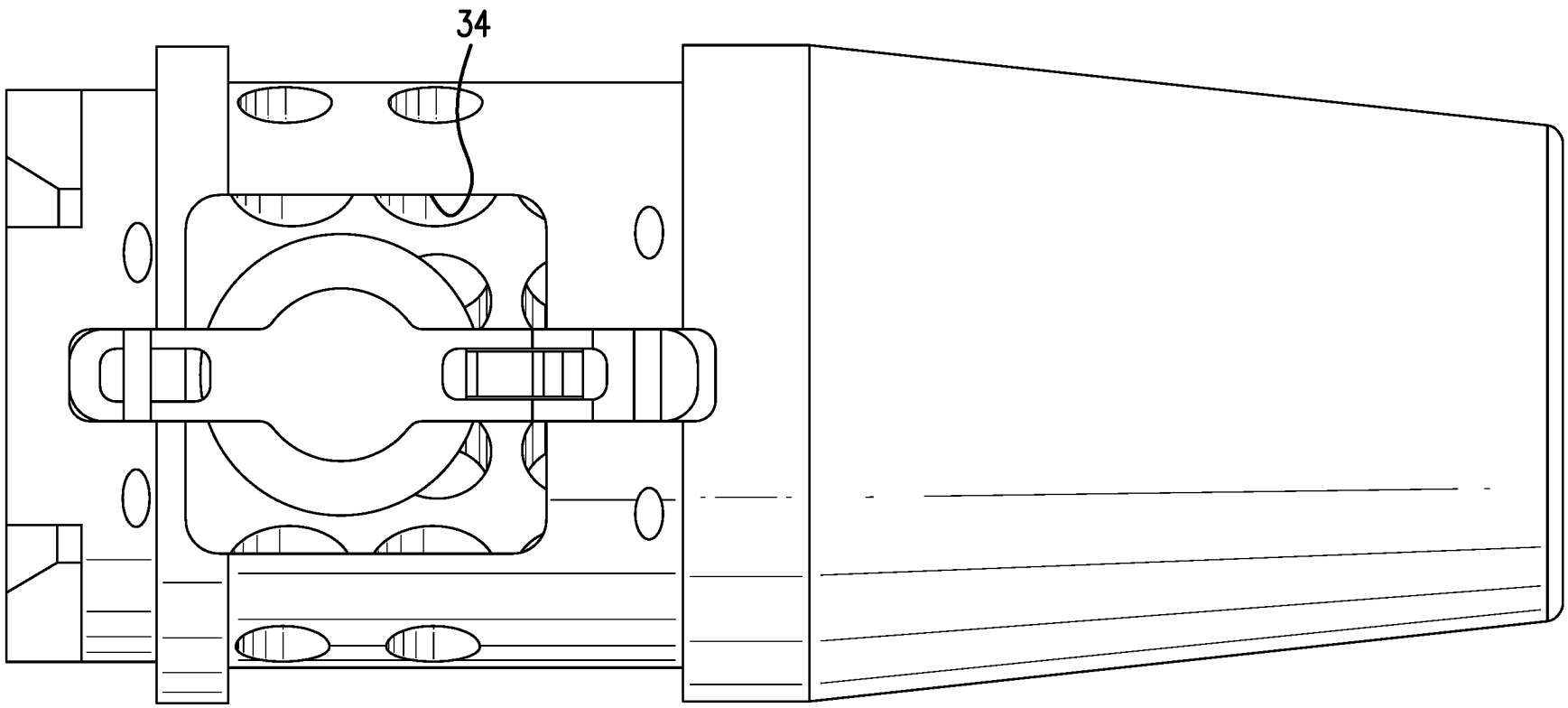
FIG. 2 is a view of the plug illustrated in FIG. 1 rotated 90 degrees.

The assembly 20 includes a frame 24 (which may be a separate member or a part of the cone body 12 itself) and a magnetic catch 26. In one embodiment the magnetic catch 26 comprises two magnets 28 and 30 that are attractively interactive with each other. As illustrated magnet 28 is mounted on the frame 24 and magnet 30 is mounted on the closure member 22 and they are aligned with one another when the closure member 22 is in the open position. It will be appreciated that movement of the closure member 22 is pivotal, dictated by pivot pin 32 and so the magnets 28 and 30 will be aligned and attracted to one another when brought near one another through pivotal movement of the closure member 22 toward the open position. In alternate embodiments, either of 28 or 30 may be substituted by a magnetically permeable material such as a ferrous member. Referring to FIG. 2 along with FIG. 1 now, it is to be appreciated that an actuation opening 34 exists in the cone body 12. It will be appreciated by those of skill in the art that fluid flowing from a left of the figure will flow around and outside of the uphole end 36 of the cone body 12 and then through the opening 34 as well as through the flow bore 16 (see double arrows in FIG. 1). The fluid flowing through the opening 34 hydrodynamically loads the closure member 22. At a selected flow rate, the hydrodynamic load will exceed the holding capability of the magnetic catch 26 and cause the closure member 22 to pivot to a seated position against seat 18. In an embodiment, the magnetic catch is set to hold 16 lbs of load and that equates to 15 barrels per minute flow rate. Therefore, any operation below 15 barrels per minute (BPM) may progress without the member 22 closing but at a rate of greater than 15 BPM, the member 22 will close. It is to be understood that the flow rate noted is for water at ambient surface temperature. If the temperature is higher, the rate will need to be higher to compensate for the lower density of the water. Alternatively, if the water is a downhole fluid that may have a density greater than water, then the rate would fall slightly relative to the point at which the magnetic catch 26 releases the closure member 22.

It should be appreciated that the figures also illustrate holes 38 (one or more of them) in the cone body 12. These holes reduce the hydrodynamic force upon the closure member 22 relative to a cone body that does not include these holes 38. Both embodiments are contemplated so that greater latitude in adjusting for desired flow rate and/or accounting for type of working fluid is available.

It is also to be appreciated that the assembly 20 may be installed upon any kind of plug by providing a housing for the assembly 20 and then connecting that housing to a plug by threading, welding, friction fit, etc.

Figure 3:
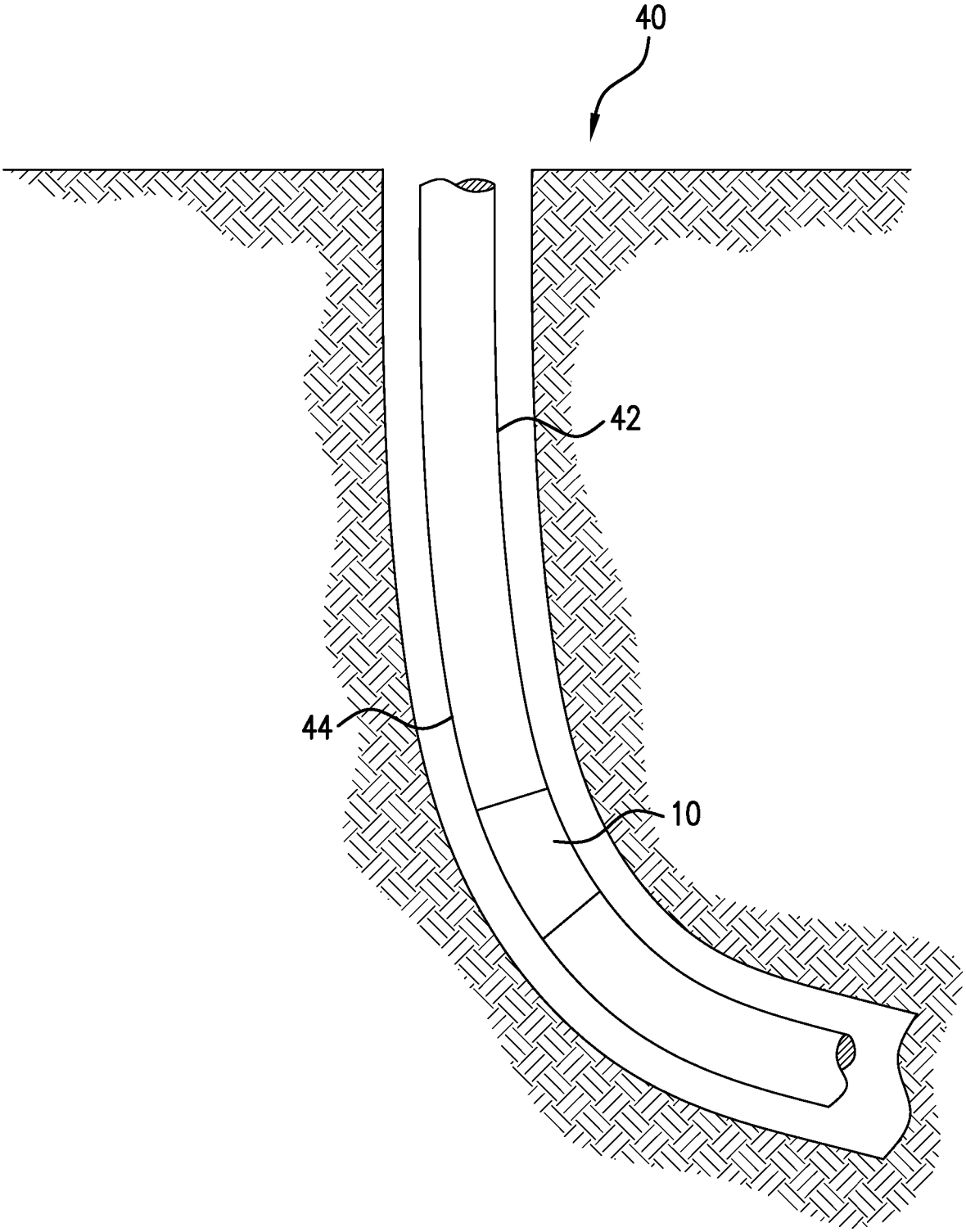
FIG. 3 is a schematic view of a wellbore system having the plug of FIG. 1 disposed therein.

Referring to FIG. 3, a wellbore system 40 includes a borehole 42, a string 44 disposed in the borehole 42 and a plug 10 disposed in the string. The wellbore system 40 may include multiple plugs 10 therein.

Set forth below are some embodiments of the foregoing disclosure:

Embodiment 1: A plug with a resettable closure member including a body defining a flow bore and a closure member seat, a closure assembly connected to the body, the assembly including a closure member and a magnetic catch disposed to hold the closure member in an open position, the magnetic catch being configured to release the closure member upon a selected hydrodynamic load upon the closure member.

Embodiment 2: The plug as in any prior embodiment further including a hole in the body.

Embodiment 3: The plug as in any prior embodiment further including a slip and seal.

Embodiment 4: The plug as in any prior embodiment wherein the closure assembly further includes a frame and a magnet disposed on the frame or on the closure member or on both.

Embodiment 5: The plug as in any prior embodiment wherein the closure member is a flapper.

Embodiment 6: The plug as in any prior embodiment wherein the plug is a frac plug.

Embodiment 7: A method for fracturing a wellbore system including flowing a fluid through a plug as in any prior embodiment; exceeding a selected flow rate associated with release of the closure member to seat on the closure seat.

Embodiment 8: The method as in any prior embodiment further comprising resetting the closure member by flowing fluid through the body in an opposite direction of flow during closure of the closure member.

Embodiment 9: The method as in any prior embodiment wherein the resetting is resetting the magnetic catch with the closure member in the open position.

Embodiment 10: The method as in any prior embodiment wherein the resetting the magnetic catch is automatic upon flowing the closure member into proximity with the frame.

Embodiment 11: A wellbore system including a borehole; a plug as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frac plug settable in a casing with a resettable closure member comprising:

a body defining a flow bore smaller than the casing in which the frac plug is settable to increase flow velocity in the flow bore and a closure member seat;

a closure assembly connected to the body, the assembly including:

a fracturing closure member, the member being disposed within the smaller flow bore and pivotable to a closed position in the same direction as fluid flowing into a wellbore through the flow bore, when in use; and a magnetic catch disposed to hold the closure member in an open position, the magnetic catch being configured to release the closure member upon a selected hydrodynamic load including load created by the increased fluid velocity acting directly upon the closure member.

2. The plug as claimed in claim 1 further including a hole in the body.

3. The plug as claimed in claim 1 further including a slip and seal operatively connected to the body.

4. The plug as claimed in claim 1 wherein the closure assembly further includes a frame and a magnet disposed on the frame or on the closure member or on both.

5. The plug as claimed in claim 1 wherein the closure member is a flapper.

6. A method for fracturing a wellbore system comprising:

flowing a fluid through a plug having a body defining a flow bore and a closure member seat, a closure assembly connected to the body, the assembly including:

a closure member, and a magnetic catch disposed to hold the closure member in an open position, the magnetic catch being configured to release the closure member upon a selected hydrodynamic load upon the closure member;

exceeding a selected flow rate associated with release of the closure member to seat on the closure seat.

7. The method as claimed in claim 6 further comprising resetting the closure member by flowing fluid through the body in an opposite direction of flow during closure of the closure member.

8. The method as claimed in claim 7 wherein the resetting is resetting the magnetic catch with the closure member in the open position.

9. The method as claimed in claim 8 wherein the resetting the magnetic catch is automatic upon flowing the closure member into proximity with the frame.

10. A wellbore system comprising:

a borehole;

a plug as claimed in claim 1 disposed in the borehole.

* * * * *